US008148041B2

(12) United States Patent
Kobayashi et al.

(10) Patent No.: US 8,148,041 B2
(45) Date of Patent: Apr. 3, 2012

(54) CARRIER AND TWO-COMPONENT DEVELOPER COMPOSED OF THE CARRIER

(75) Inventors: Makoto Kobayashi, Tokyo (JP); Yoshiaki Kobayashi, Tokyo (JP); Yoshiyasu Matsumoto, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/012,127

(22) Filed: Jan. 24, 2011

(65) Prior Publication Data

US 2011/0117488 A1 May 19, 2011

Related U.S. Application Data

(63) Continuation of application No. 11/835,700, filed on Aug. 8, 2007, now abandoned.

(30) Foreign Application Priority Data

Sep. 14, 2006 (JP) ..... 2006-249190

(51) Int. Cl.
*G03G 9/107* (2006.01)

(52) U.S. Cl. ..... 430/137.13; 430/111.31; 430/111.33

(58) Field of Classification Search ..... 430/137.1, 430/137.13, 111.31, 111.32, 111.33
See application file for complete search history.

(56) References Cited

U.S. PATENT DOCUMENTS

| | | | | |
|---|---|---|---|---|
| 6,677,096 | B2 * | 1/2004 | Tachi et al. | 430/108.7 |
| 2003/0175611 | A1 | 9/2003 | Fujii | |
| 2007/0154833 | A1 | 7/2007 | Kayamoto | |

FOREIGN PATENT DOCUMENTS

| | | | |
|---|---|---|---|
| JP | 2001-93720 | A | 4/2001 |
| JP | 2003-337445 | A | 11/2003 |
| JP | 2004-240321 | A | 8/2004 |
| WO | 2005/062132 | A2 | 7/2005 |

OTHER PUBLICATIONS

Form 892 from US Office Action for U.S. Appl. No. 11/835,700 mailed on Jun. 9, 2010.

* cited by examiner

*Primary Examiner* — Janis L Dote
(74) *Attorney, Agent, or Firm* — Cantor Colburn LLP

(57) ABSTRACT

An objective is to provide a carrier exhibiting stable charge providing ability in which sufficient charge can be provided to toner having a small particle diameter, and no image contamination such as fog caused by toner scattering via lack of electrification is generated. Another objective is to provide a carrier capable of maintaining a charging level of no interference for image formation even under the image forming condition at which a charging level for printing a number of prints continuously is difficult to be maintained. Disclosed is a carrier comprising a core particle made of ferrite possessing Mg and coated thereon, a resin, wherein the core particle has a ratio of the number of irregular-shaped core particles of at most 5%, based on the total number of core particles, and a surface of the core particle has grains having a maximum grain diameter of 2-5 μm.

8 Claims, 1 Drawing Sheet

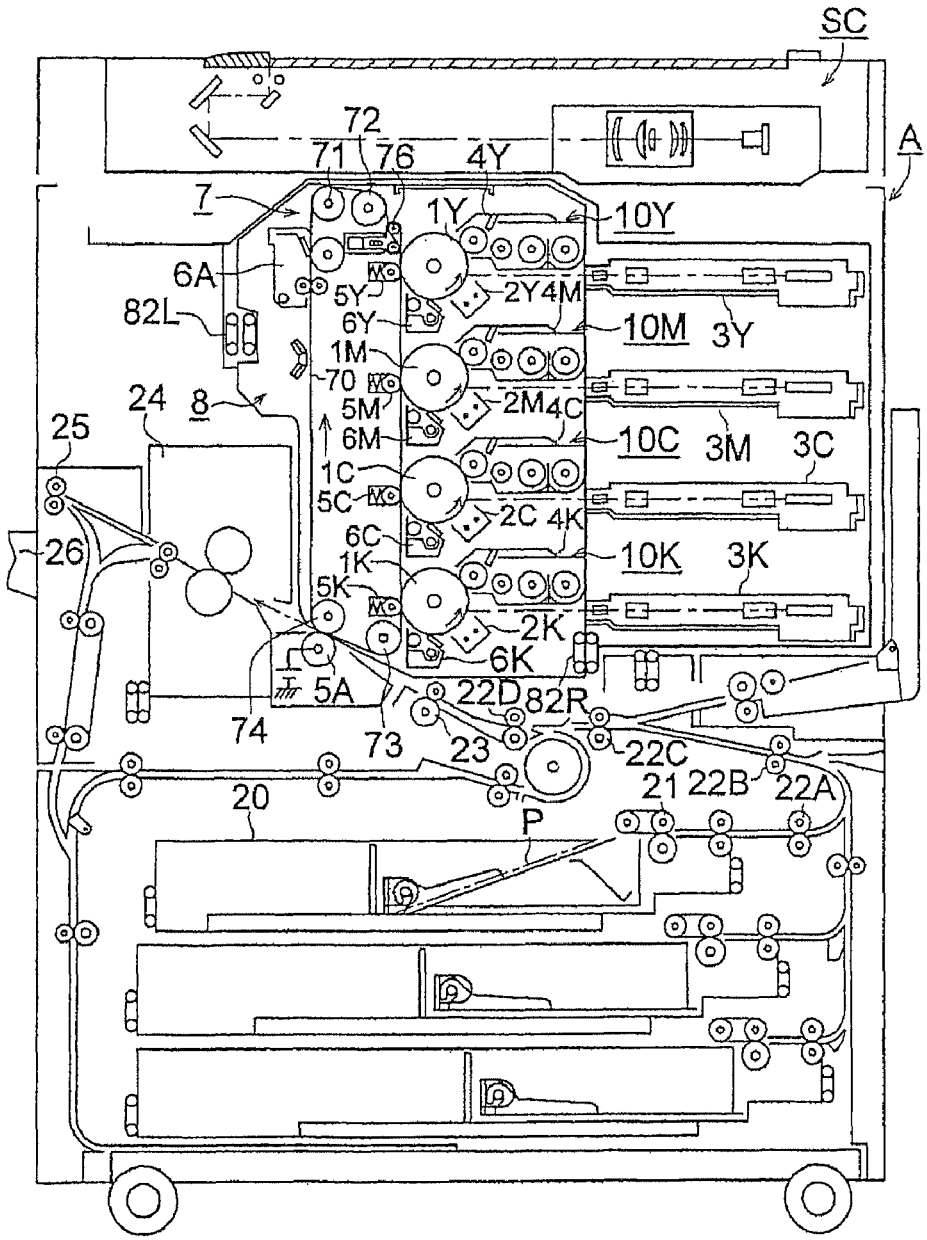
SC
A
72
71
76
4Y
7
1Y
10Y
6A
5Y
2Y
4M
82L
6Y
10M
3Y
1M
70
5M
2M
4C
24
8
25
6M
10C
3M
3C
1C
5C
2C
4K
26
6C
1K
10K
3K
5K
2K
6K
5A
22D
82R
74
73
23
22C
21
22B
22A
20
P

CARRIER AND TWO-COMPONENT DEVELOPER COMPOSED OF THE CARRIER

The present application is a continuation application of U.S. patent application Ser. No. 11/835,700, filed on Aug. 8, 2007, the entire contents of which are incorporated herein by reference. The Ser. No. 11/835,700 application claimed the benefit of the date of the earlier filed Japanese Patent Application No. JP 2006-249190 filed Sep. 14, 2006, the benefit of which is also claimed herein.

TECHNICAL FIELD

The present invention relates to a carrier constituting a two-component developer utilized for electrophotographic image formation, and specifically to a carrier formed from ferrite containing magnesium.

BACKGROUND

As an electrophotographic image forming method, there is an image forming method comprising the step of developing an electrostatic latent image on an image carrier employing a two-component developer composed of toner and carrier to form a toner image. The carrier constituting this two-component developer is broadly divided into a conductive carrier composed of oxidized iron powder or nonoxidized iron powder, and an insulating carrier evenly covering an insulating resin on the surface of a core particle called a carrier core composed of a ferromagnetic material such as iron, nickel or such. Of these, the insulating carrier has an advantage of excellent durability and longer life over the conductive carrier, and is employed as a carrier suitable for high-speed image formation.

There is provided ferrite as raw material for a carrier core. Ferrite is α-iron having a body-centered cubic crystal, or a solid solution of a divalent transition metal such as Ni, Cu, Co, Mn, Zn or such into the α-iron. In this situation, the solid solution of a divalent transition metal such as Ni, Cu or such exhibits an excellent property as a carrier core, but there is a recent move to aim for product safety via removal of harmful substances to humans from business machines and home appliances. For example, Restriction of Hazardous Substances (RoHS) to ban using specific 6 substances for electrical and electronic products sold in EU is to be a typical example.

Since there is concern that Cu and Zn are accumulated in living organism though they are not RoHS regulation substances, solid solution type ferrite containing no such metals has been intensively studied, and as a result, attention is currently focused on Mg-containing ferrite.

There is the following carrier technique employing Mg-containing ferrite. For example, there is a method of producing MnO—MgO—$Fe_2O_3$ system soft ferrite by baking oxide raw material in the presence of a mixed gas formed from an oxygen gas and an inert gas (refer to Patent Document 1, for example).

Also provided is a technique of producing a carrier by coating a polymethylalkyl siloxane-added resin on the surface of a soft ferrite particle having a MnO—MgO—$Fe_2O_3$ composition (refer to Patent Document 2, for example).

Further, there is a technique of producing a carrier core by adding metal oxide such as $Bi_2O_3$ having a melting point of at most 1000° C. and metal oxide such as $ZrO_2$ having a melting point of at least 1800° C. into Mg-containing ferrite (refer to Patent Document 3, for example).

In this way, the carrier technique employing Mg-containing ferrite has been studied.

(Patent Document 1) Japanese Patent O.P.I. Publication No. 2001-93720

(Patent Document 2) Japanese Patent O.P.I. Publication No. 2003-337445

(Patent Document 3) Japanese Patent O.P.I. Publication No. 2004-240321

SUMMARY

There has been demanded high-definition image formation for dot image reproduction at a level of precise reproduction of minute dot images at a level of 1200 dpi (dpi: the number of dots per inch or 2.54 cm) along with advancement of digital technologies. Accordingly, reduction of toner particle size has been studied as a means to realize minute dot images, and along with this, a carrier smaller than before has also been demanded. A carrier with the foregoing Mg-containing ferrite has also been studied in order to realize the carrier having a reduced particle size.

However, when a carrier core having a reduced particle size was produced employing Mg-containing ferrite, it was found out that toner could not be sufficiently charged. Particularly, when printing a number of prints continuously, charge providing ability into toner is lowered with an increase of the number of prints, and toner scattering is generated, whereby image contamination such as fog is generated. In this way, stable charge providing ability to toner was not possible to be obtained, even though the carrier core having a reduced particle size was produced employing Mg-containing ferrite.

It is an object of the present invention to provide a carrier exhibiting stable charge providing ability in which sufficient charge can be provided even in combination with toner having a small particle diameter, and no image contamination such as fog caused by toner scattering via lack of electrification is generated. It is another object of the present invention to provide a carrier capable of maintaining a charging level of no interference for image formation even under the image forming condition at which a charging level for printing a number of prints continuously is difficult to be maintained. Also disclosed is a carrier comprising a core particle made of ferrite comprising Mg and coated thereon, a resin, wherein the core particle has a ratio of the number of irregular-shaped core particles of at most 5%, based on the total number of core particles, and a surface of the core particle has grains having a maximum grain diameter of 2-5 μm.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which: FIG. 1 is a schematic diagram showing an example of an image forming apparatus employed in the present invention.

DESCRIPTION OF THE PREFERRED EMBODIMENTS

The above object of the present invention is accomplished by the following structures.

(Structure 1) A carrier comprising a core particle made of ferrite comprising Mg and coated thereon, a resin, wherein the core particle has a ratio of the number of irregular-shaped core particles of at most 5%, based on the total number of core particles, and a surface of the core particle has grains having a maximum grain diameter of 2-5 μm.

(Structure 2) The carrier of Structure 1, having an average particle diameter of 20-40 μm.

(Structure 3) The carrier of Structure 1, wherein the core particle comprises Mn.

(Structure 4) A two-component developer comprising the carrier of Structure 1 and a toner having a volume-based median diameter ($D_{50}$) of 3-8 μm.

(Structure 5) The carrier of Structure 1, wherein the maximum grain diameter is 2-4 μm.

(Structure 6) The carrier of Structure 2, wherein the average particle diameter is 25-37 μm.

(Structure 7) The carrier of Structure 1, having a magnetic attraction of 40-70 $Am^2/kg$.

(Structure 8) The carrier of Structure 7, wherein the magnetic attraction is 45-60 $Am^2/kg$.

(Structure 9) The carrier of Structure 1, wherein a layer to coat the surface of the core particle covers the surface at least 70% in surface area.

(Structure 10) The carrier of Structure 1, formed via one trial of baking.

(Structure 11) The carrier of Structure 10, wherein the one trial of baking has a baking temperature of at least 1500° C.

(Structure 12) The carrier of Structure 10, wherein a slurry concentration employed in the one trial of baking is at least 70% by weight.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The effect of the present invention can be produced by utilizing a carrier comprising a core particle made of ferrite comprising Mg and coated thereon, a resin, and the core particle having a ratio of the number of irregular-shaped core particles of at most 5%, based on the total number of core particles, together with a surface of the core particle comprising a maximum grain diameter of 2-5 μm. The way the core particle producing such the effect is found out about will be described below.

When the inventors prepared carrier cores via a conventional method, employing ferrite comprising Mg to observe these cores, they focused attention on the fact that shape of each carrier core is very uneven. In this case, shape unevenness of carrier cores affects charge providing ability to toner, whereby any carrier tends to provide the same level of electrification to toner by making the shape uniform, and stable toner electrification is presumably realized.

Thus, thinking that the cause of unevenness of carrier core shape was dependent upon stress applied in a process of preparing the carrier core, baking as the largest factor to apply stress to the carrier core was kept to a bare minimum to prepare the carrier core.

The inventors further focused attention on carrier core surface smoothness, and evaluated the surface condition of carrier cores in uniform shape and carrier cores in nonuniform shape employing a scanning electron microscope. It was found out via observation of the carrier core surface with the electron microscope that the core surface was composed of an infinite number of independent regions (grains), and the carrier core in higher uniform shape tended to have a smaller grain area.

That is, the effect of the present invention was produced by obtaining a core particle made of ferrite containing at least Mg, having a ratio of the number of irregular-shaped core particles of at most 5%, based on the total number of core particles, together with a surface of the core particle comprising a maximum grain diameter of 2-5 μm via the above-described preparation process.

By making the carrier core to have a ratio of the number of irregular-shaped core particles of at most 5%, based on the total number of core particles, spherical shape is arranged to be realized, the thickness of a resin coated onto the particle becomes more uniform, and core particle surface smoothness becomes better by further minimizing a diameter of the grain generated on the core particle surface, whereby sufficient electrification to toner is possible to be evenly provided.

Next, the present invention will be described.

Characteristic of Carrier

The carrier of the present invention will be described.

The carrier of the present invention has a structure in which a resin is coated onto the surface of a core particle made of ferrite containing at least Mg. The formed core particle has a ratio of the number of irregular-shaped core particles of at most 5%, based on the total number of core particles, and is formed from ferrite containing at least Mg, utilizing a surface of the core particle comprising a maximum grain diameter of 2-5 μm.

The core particle (referred to also as carrier core) constituting carrier of the present invention is made of a so-called ferrite which is ferric oxide ($Fe_2O_3$) as a principal component, and contains at least Mg. Ferrite containing Mn in the foregoing component is also preferably usable.

In the present invention, the core particles are adjusted to a ratio of the number of irregular-shaped core particles of at most 5%, based on the total number of core particles. The ratio of the number of irregular-shaped core particles indicates a ratio of the number of nonuniform-shaped core particles to the specific number of extracted core particles to know evenness of core particle shape. Thus, this means that the lower the ratio of the number of irregular-shaped core particles, the more uniform-shaped even core particles are obtained, and the higher the ratio of the number of irregular-shaped core particles, the more nonuniform-shaped core particles are obtained.

In the present invention, the core particles are adjusted to a ratio of the number of irregular-shaped core particles of at most 5%, based on the total number of core particles, but the carrier exhibiting charge providing ability provided uniformly can be obtained by achieving the uniformity in core particle shape so as to set the ratio in the foregoing range. That is, uniform core particle shape can realize a resin formed on the core particle surface at the same level, and also a large amount of carrier exhibiting charge providing ability at the same level, whereby stable toner electrification can be conducted.

A specific method of calculating the ratio of the number of irregular-shaped core particles is taken with the following procedure. That is, core particles are micrographed at a magnification of 300 times employing a scanning electron microscope (SEM), and the ratio of the number of irregular-shaped core particles to the following defined 500 core particles on a photographic image is calculated to determine the ratio.

Herein, an irregular-shaped core particle means a nonuniform-shaped core particle, and for example, means a core particle in crashed shape (having a cross-section generated by crashing) or a core particle having a protrusion portion such as a lump and the like.

A specific method to define the irregular-shaped core particle is described below. "Largest diameter of core particle in horizontal Feret diameter" and "projected area of core particle" are measured via 100 core particle images micrographed employing a scanning electron microscope to determine SF-1, utilizing the following formula, and core particles having a SF-1 of larger than 130 are designated as irregular-shaped core particles.

SF-1={(largest diameter of core particle in horizontal Feret diameter)$^2$/(projected area of core particle)}×(π/4)×100; provided that the projected area refers to the area of a projected image of a core particle projected onto a plane.

Next, Grains of a carrier will be described.

In the present invention, a maximum grain diameter generated on the carrier particle surface is at most 2-5 μm.

When core particles constituting the carrier of the present invention are observed at a magnification of 1500-3000 times employing an electron microscope, it is confirmed that the surface has a structure in which an infinite number of crashed granules seem to adhere to each other. In the present invention, independent regions having a structure with crashed granules constituting the core particle surface are called "grains", and "maximum grain diameter" is one represented as the largest grain among grains observed on the core particle surface in terms of a horizontal Feret diameter. In addition, the horizontal Feret diameter is represented as the distance of two parallel lines tangent to the profile of the particle, the two parallel lines are each crossing at right angle with the horizontal direction of an electron micrographic image, and this represents a grain diameter of a core particle.

The maximum grain diameter of the present invention is calculated by the following procedure.

As to a measurement method, a core particle is micrographed at a magnification of 3000 times employing a scanning electron microscope (SEM), a horizontal Feret diameter of each grain on the core particle surface in the photographic visible field via the image taken into a scanner is measured employing an image processing analyzer (Luzex AP, manufactured by Nireco Corporation) to extract the largest drain diameter.

One hundred core particles are measured by this method to determine the mean value obtained from the largest drain diameter of each core particle, and this represents the maximum grain diameter on the core particle surface.

In the present invention, the maximum grain diameter on the core particle surface is 2-5 μm, and preferably 2-4 μm. When the maximum grain diameter is within the above-described range, the core particle surface is evenly roughened, and a resin is easy to be evenly coated, whereby presumably, electrification can be evenly provided to toner.

In addition, it is difficult in preparation of core particles and is not practically available to make the maximum grain diameter to be less than 2 μm, since a process of sorting particles is desired to be arranged after preparing core particles.

The carrier of the present invention will further be described.

The carrier of the present invention preferably has an average particle diameter of 20-40 μm, and more preferably has an average particle diameter of 25-37 μm. It is possible to provide a two-component developer capable of high-resolution toner image formation associated with digitization, since an appropriate mixture can be produced with the toner having a small diameter capable of reproducing fine dot images by setting an average particle diameter within the above-described range.

The average particle diameter of carrier is possible to be calculated by a volume-based measurement method. The volume-based average particle diameter of carrier can be measured employing a laser diffraction type particle size distribution measurement apparatus HELOS (manufactured by SYMPATEC Co.) equipped with a wet distributor.

The carrier preferably has a magnetic attraction of 40-70 Am$^2$/kg, and more preferably has a magnetic attraction of 45-60 Am$^2$/kg. No scattering and conveyance trouble of the carrier are generated, since the carrier is well held with a magnet of a developing device by setting the magnetic attraction within the above-described range.

In addition, the magnetic attraction of the carrier is possible to be measured the following procedure, for example. That is, it is measured with a specimen quantity of 20-30 mg at a measurement magnetic field of 5 kOe employing a high sensitivity type vibrating sample magnetometer (VSM-P7-15 type, manufactured by Toei Industry co. Ltd.), for example, as a measuring apparatus.

Next, a method of preparing the carrier of the present invention will be described.

In the present invention, the inventors thought that no stress was applied in a manufacturing process as much as possible in such a way that uniform-shaped carrier cores exhibiting a uniform property were obtained during preparation of the carrier cores, and found out the preparation condition at which baking as the largest factor to apply stress to the carrier core was possible to be completed in one trial.

The carrier core is prepared via the steps of granulating ferrite as raw material, conducting a drying treatment, subsequently baking the resulting via heating, and pulverizing the resulting baked material. In the case of preparing carrier cores specifically by using ferrite containing Mg, the baking duration takes longer since dispersibility of Mg is not good, whereby baking is to be conducted twice. That is, after conducting a heat treatment called preliminary baking at 1200-1500° C., a pulverizing treatment was conducted, and subsequently a heat treatment called major baking was conducted at 1100-1400° C. via granulating and drying steps.

In the process of preparing carrier cores, the carrier cores having a desired particle diameter can be obtained by pulverizing the resulting baked material, and classifying the pulverized material. In the pulverizing step, mechanical stress is applied to the baked material to form particles, but the smaller the particle diameter, the larger the load is applied with the baked material. Accordingly, the carrier core having a smaller particle diameter tends to easily be nonuniform-shaped, and grains on the surface tend to easily be larger. In this way, carrier cores in nonuniform shape having large grains on the surface can not provide electrification sufficiently to toner presumably because of ferrite exhibiting low density.

In the present invention, in order to reduce stress applied to the baked material via the pulverizing treatment as much as possible during preparation of carrier cores, baking was conducted in one trial to produce carrier cores. Therefore, realized was a situation where Mg component was sufficiently sintered in one trial of baking. Specifically, a raw material addition amount to slurry used in the preparation process is increased, and a high viscosity degree is made by adjusting the slurry concentration to at least 70% by weight to have a larger share with respect to Mg, and to increase dispersibility while heating at a baking temperature of at least 1500° C., whereby carrier cores exhibiting excellent dispersibility of Mg is obtained by completing sintering of Mg even for a short period of time.

Next, the typical preparation procedure of the carrier in the present invention will be described.

(1) Preparation of Raw Material

This is a process of preparing raw material to produce ferrite containing Mg. In the case of preparing ferrite containing Mg, compounds such as ferric oxide ($Fe_2O_3$), magnesium hydroxide {$Mg(OH)_2$}, and manganese carbonate {$MnCO_3$} are mixed in a predetermined ratio. $Mg(OH)_2$ preferably has 10-40 mol %, based on the above-described raw material.

(2) Wet Mixing

This is a process possessing the steps of adding water into the mixture obtained in (1), dispersing the resulting to prepare slurry, and also adjusting the slurry concentration in order to produce viscosity capable of smoothly conducting a treatment in the next process. In the present invention, Mg can be sufficiently sintered in one trial of sintering by adjusting the slurry concentration to 70-80% by weight.

(3) Wet Pulverization

This is a process of conducting a pulverization treatment by introducing the slurry into an apparatus such as a wet ball mill or a wet vibratory mill to obtain pulverized material. A pulverized material of at most 15 μm in size is acquired, and it is also possible to produce a pulverized material of at most 2 μm in size.

(4) Granulating and Drying

This is a process possessing the steps of supplying the pulverized material into a spray dryer, spraying the pulverized material with the spray dryer, and drying the resulting to prepare a ferrite granulated material having a predetermined particle diameter.

(5) Baking

This is a process possessing the steps of introducing the ferrite granulated material into a baking furnace, conducting a heat treatment, and baking the ferrite granulated material. In the present invention, Mg can be sufficiently sintered in one trial of sintering by heating the granulated material made from the foregoing slurry at a temperature of at least 1500° C. The baking time is 1-24 hours, and preferably 2-10 hours.

(6) Pulverization

This is a process of pulverizing a baked material employing a pulverizer.

(7) Classification

This is a process of obtaining carrier cores by classifying the pulverized material through a sieve to extract ferrite having a predetermined particle diameter. Examples of the classification method include a sieve filtration method, a sedimentation method and a wind power method.

It is possible to directly coat a resin on the carrier core obtained in this way, but is also possible to adjust electric resistivity by anodizing the carrier core via heating under ambient atmosphere. The carrier core exhibiting high resistivity can be obtained via an anodization treatment by carrying out a heat treatment at 300-700° C. for 1-180 minutes employing, for example, a rotary type electric furnace or a batch type electric furnace.

Examples of resins coatable on the carrier core surface include an olefin based resin, a styrene based resin, a styrene acrylic resin, an acrylic resin, a silicone based resin, an ester based resin and a fluorine-containing polymer based resin. In addition, examples of the method of coating a resin include a wet coating method and a dry coating method.

The coated layer preferably covers the core particle surface at least 70% in surface area.

The spray coating method as a wet coating method is a method of forming a coating layer via drying by spray coating a coating solution, in which a coating resin is dissolved in a solvent, onto the carrier core. The immersion coating method as a similar wet coating method is also a method of forming a coating layer via drying by immersing the carrier core in a coating solution in which a coating resin is dissolved in a solvent.

As a dry coating method, also provided is, for example, a method of welding or softening the resin particle via application of mechanical impact after coating the resin particle onto the carrier core surface to be covered.

Further, there is a method called a polymerization coating method. This is a method of coating via polymerization reaction by applying heat, after immersing the carrier core in a coating solution, in which a polymerizable monomer is dissolved in a solvent, to carry out a coating treatment.

In the present invention, it is also possible to utilize a two-component developer comprising the above-described carrier and the toner having a volume-based median diameter ($D_{50}$) of 3-8 μm.

Along with advancement of digital technologies, not only studied has been a toner having a small diameter, capable of precisely reproducing minute dot images, but also demanded has been a carrier having a small diameter, capable of providing appropriate electrification to such the toner having a small diameter. Reduction of carrier size is realized by a carrier made of ferrite containing the above-described Mg, whereby it is possible to provide a two-component developer suitable for minute dot image formation.

In addition, the volume-based median diameter ($D_{50}$) of toner can be measured and calculated employing an apparatus in which a computer system for data processing is connected to Multisizer 3 (manufactured by Beckman Coulter Co.).

As to the measurement procedure, an amount of 0.02 g of toner is added to 20 ml of a surfactant solution (which is prepared by diluting a neutral detergent containing surfactant components 10 times with pure water) and dispersed for 1 min. by using an ultrasonic homogenizer to obtain a toner dispersion. The toner dispersion is poured by a pipette into a beaker in which ISOTON II (Beckman Coulter Co.) is placed with a sample stand, until reaching 5-10% by weight of a measurement concentration. The measurement count is set to 25000 to perform measurement. Coulter Multisizer 3 having an aperture diameter of 50 μm is employed.

A toner image developed by the carrier of the present invention or a two-component developer is preferably utilized for an image forming apparatus comprising a fixing device by which fixing is conducted by passing through between heating members, employing a contact type fixing process.

Next, the image forming apparatus will be described.

FIG. 1 is a schematic diagram showing an example of an image forming apparatus of the present invention. In FIG. 1, each of 1Y, 1M, 1C and 1K is a photoreceptor, each of 4Y, 4M, 4C and 4K is a developing means, each of 5Y, 5M, 5C and 5K is a primary transfer roller representing a primary transfer means, 5A represents a secondary transfer roller representing a secondary transfer means, each of 6Y, 6M, 6C and 6K is a cleaning means, numeral 7 represents an intermediate transfer unit, numeral 24 represents a heat roll type fixing device and numeral 70 represents an intermediate transfer member.

This image forming apparatus is called a tandem type color image forming apparatus, and it has therein plural sets of image forming sections 10Y, 10M, 10C and 10K, endless belt type intermediate transfer unit 7 representing a transfer section, endless belt type sheet feeding conveyance means 21 that conveys recording member P and heat roll type fixing device 24. On the upper part of main body A of the image forming apparatus, there is arranged document image reading device SC.

Image forming section 10Y that forms an image of a yellow color as one of toner images in different colors formed from each photoreceptor has therein drum-shaped photoreceptor 1Y as a first photoreceptor, charging means 2Y arranged around photoreceptor 1Y, exposure means 3Y, developing means 4Y, primary transfer roller 5Y as a primary transfer means and cleaning means 6Y. Image forming section 10M that forms an image of a magenta color as one of a toner image in another different color has therein drum-shaped photoreceptor 1M as a first photoreceptor, charging means 2M arranged around the photoreceptor 1M, exposure means 3M, developing means 4M, primary transfer roller 5M as a primary transfer means and cleaning means 6M. Image forming section 10C that forms an image of a cyan color as one of a toner image in still another different color has therein drum-shaped photoreceptor 1C as a first photoreceptor, charging means 2C arranged around photoreceptor 1C, exposure means 3C, developing means 4C, primary transfer roller 5C as a primary transfer means and cleaning means 6C. Further, image forming section 10K that forms an image of a black color as one of a toner image in still more another different color has therein drum-shaped photoreceptor 1K as a first photoreceptor, charging means 2K arranged around photoreceptor 1K, exposure means 3K, developing means 4K, primary transfer roller 5K as a primary transfer means and cleaning means 6K.

Endless belt type intermediate transfer unit 7 has endless belt type intermediate transfer member 70 as a second photoreceptor in the form of an intermediate transfer endless belt, which is rolled by plural rollers, and supported rotatably.

Images each being in a different color formed respectively by image forming sections 10Y, 10M, 10C and 10K are transferred sequentially onto rotating endless belt type intermediate transfer member 70 respectively by primary transfer rollers 5Y, 5M, 5C and 5K, whereby a combined color image is formed. Recording member P such as a sheet as a transfer material loaded in sheet-feeding cassette 20 is fed by sheet-feeding conveyance means 21, to be conveyed to secondary transfer roller 5A as a secondary transfer means through plural intermediate rollers 22A, 22B, 22C and 22D as well as registration roller 23, thus, the color images are transferred all together onto the recording member P. The recording member P onto which the color image has been transferred is fixed by heat roll type fixing device 24, and is interposed by sheet-ejection roller 25 to be placed on sheet-ejection tray 26 located outside the apparatus.

On the other hand, after the color image is transferred by second transfer roller 5A onto recording member P, toner remaining on endless belt type intermediate transfer member 70 is removed from endless belt type intermediate transfer member 70 via curvature separation of recording member P, by cleaning means 6A.

During image forming processing, primary transfer roller 5K is constantly in pressure contact with photoreceptor 1K. Other primary transfer rollers 5Y, 5M and 5C are in pressure contact respectively with corresponding to photoreceptors 1Y, 1M and 1C only in the course of color image forming.

Second transfer roller 5A comes in contact with endless belt type intermediate transfer member 70 only when recording member P passes through second transfer roller 5A and the secondary transfer is carried out.

Enclosure 8 is designed to be drawn out of apparatus main body A through supporting rails 82L and 82R.

Enclosure 8 has therein image forming sections 10Y, 10M, 10C and 10K, as well as endless belt type intermediate transfer unit 7.

Image forming sections 10Y, 10M, 10C and 10K are arranged in tandem in the vertical direction. On the left side of photoreceptors 1Y, 1M, 1C and 1K, there is arranged endless belt type intermediate transfer unit 7. Endless belt type intermediate transfer unit 7 possesses endless belt type intermediate transfer member 70 rotatable via rotation of rollers 71, 72, 73, 74 and 76, primary transfer rollers 5Y, 5M, 5C and 5K, and cleaning means 6A.

When enclosure 8 is drawn out, image forming sections 10Y, 10M, 10C and 10K as well as endless belt type intermediate transfer unit 7 are drawn out all together from main body A.

In this way, a toner image is formed on each of photoreceptors 1Y, 1M, 1C and 1K through charging, exposure and developing, then, toner images having respective colors are superimposed each other on endless belt type intermediate transfer member 70, and they are transferred all together onto recording member P, to be fixed by heat roll type fixing device 24 through application of pressure and heating. Each of photoreceptors 1Y, 1M, 1C and 1K, after the toner image thereon has been transferred onto recording member P, is cleaned by cleaning means 6A to remove remaining toner on the photoreceptor during transferring, and then, the photoreceptors enter the above-described cycle of charging, exposure and developing so that succeeding image forming may be carried out.

Example

Next, the embodiments of the present invention will now be detailed employing examples, but the present invention is not limited thereto.

1. Preparation of Core Particle (Preparation of Core Particle A)

The raw material was prepared so as to make 50 mol % of $Fe_2O_3$, 25 mol % of $Mg(OH)_2$ and 25 mol % of $MnCO_3$. Then, 1% by weight of binder (San Nopco SN Dispersant 5468, produced by San Nopco Limited) and water were added into the foregoing mixture to prepare slurry having a content of 80% by weight. After pulverizing the resulting slurry with a wet ball mill, the pulverized material was charged into a spray dryer to prepare a granulated material, and dried.

Next, the granulated material was charged into a baking furnace, and baked under ambient atmosphere at 1600° C. for 3 hours (the first trial of baking). The resulting baked material was degranulated, and classified through a sieve to obtain "core particle A". The average particle diameter, the ratio of the number of irregular-shaped core particles based on the total number of core particles, and the maximum grain diameter of the resulting core particle A are shown in Table 1.

(Preparation of Each of Core Particle B-Core Particle E)

Each of core particle B-core particle E was prepared similarly to preparation of core particle A, except that the slurry content and the baking condition of core particle A were replaced by those shown in Table 1.

(Preparation of Core Particle F)

The raw material was prepared in the same mol % ratio as in preparation of core particle A. Then, 1% by weight of binder (San Nopco SN Dispersant 5468, produced by San Nopco Limited) and water were added into this mixture to prepare slurry having a content of 70% by weight. After pulverizing the resulting slurry with a wet ball mill, the pulverized material was charged into a spray dryer to prepare a granulated material, and dried.

Next, the granulated material was charged into a baking furnace, and previously baked under ambient atmosphere at 1100° C. for 3 hours (the first trial of baking). The resulting previously baked material was cooled down, and subsequently pulverized to a size of approximately 1 μm employing a vibratory mill. The slurry was prepared with the powder obtained via pulverization by the same method described above, and the resulting slurry was pulverized employing a wet ball mill. Subsequently, the pulverized material was charged into a spray dryer to prepare a granulated material, and dried.

Next, the granulated material was charged into the baking furnace, and baked under ambient atmosphere at 1450° C. for 3 hours (the second trial of baking). The resulting baked material was degranulated, and classified through a sieve to obtain "core particle F".

(Preparation of Core Particle G and Core Particle H)

Each of core particle G and core particle H was prepared similarly to preparation of core particle F, except that the slurry content and the baking condition of core particle F were replaced by those shown in Table 1.

The preparation condition of the core particle, the particle diameter of the resulting particle, the ratio of the number of irregular-shaped core particles based on the total number of core particles, and the maximum grain diameter are shown in Table 1.

TABLE 1

| Core particle | Slurry content (% by weight) | Baking condition: The number of trials of baking | Baking condition: First trial baking temperature (° C.) | Baking condition: Second trial baking temperature (° C.) | 1* | 2* | 3* |
|---|---|---|---|---|---|---|---|
| Core particle A | 80 | 1 | 1600 | — | 2 | 4 | 30 |
| Core particle B | 80 | 1 | 1550 | — | 3 | 2 | 30 |
| Core particle C | 70 | 1 | 1600 | — | 5 | 3 | 20 |
| Core particle D | 70 | 1 | 1700 | — | 5 | 5 | 40 |
| Core particle E | 75 | 1 | 1500 | — | 3 | 5 | 30 |
| Core particle F | 70 | 2 | 1100 | 1450 | 10 | 5 | 30 |
| Core particle G | 50 | 2 | 1150 | 1400 | 8 | 7 | 30 |
| Core particle H | 50 | 2 | 1250 | 1500 | 15 | 10 | 30 |

1*: Ratio of the number of irregular-shaped core particles based on the total number of core particles (%)
2*: Maximum grain diameter (μm)
3*: Average particle diameter (μm)

(Preparation of Carrier)

Into a high-speed mixer equipped with stirring blades, charged were 100 parts of each of "core particle A"-"core particle H" and 5 parts of copolymer (cyclohexyl methacrylate-methyl methacrylate) resin particles (a copolymerization ratio of 5/5), and a resin coated layer was formed on the core particle surface via mechanical impact by mixing at 120° C. for 30 minutes while stirring to prepare each of "carrier A"-"carrier H" covered by the resin.

(Preparation of Toner)

Three kinds of toners 1-3 such as black toner having a volume-based median diameter ($D_{50}$) of 3.0 μm (called toner 1), black toner having a volume-based median diameter ($D_{50}$) of 6.0 μm (called toner 2), and black toner having a volume-based median diameter ($D_{50}$) of 9.0 μm (called toner 3) were prepared.

(Preparation of Developer)

Mixed were 100 parts of one of "carrier A"-"carrier H" prepared above and one of toner 1-toner 3 with toner content (% by weight) described in Table 2 employing a HENSCHEL mixer manufactured by Mitsui Miike Chemical Engineering Co., Ltd to prepare "developer 1"-"developer 8".

Each of "developer 1"-"developer 8" prepared above was introduced into an image forming apparatus (bizhub C450, manufactured by Konica Minolta Business Technologies, Inc.), and a black image having a pixel ratio of 10% (a text image having a pixel ratio of 6%, a portrait, a solid white image, and a solid black image, and an original image allocating 1% for each of solid black images) was printed out on the A4 size fine-quality paper sheet in a sheet-by-sheet intermittent mode at room-temperature and humidity (25° C. and 55% RH) to obtain 50000 prints.

(Evaluation of Fog)

Fog is evaluated and obtained from density difference between not printed white paper and printed white paper. The absolute image density of not printed white paper was first measured at 20 points employing a Macbeth reflection densitometer RD-918, and the calculated average value was specified as the white paper density. Next, the absolute density of the white image portion in the 50,000$^{th}$ printed image for evaluation was similarly measured at 20 points, and the average value was calculated to evaluate the value obtained via subtraction of the white paper density from the average density, as fog density. In the case of fog density of at most 0.01, fog produces no problem in practical use.

(Evaluation of Charging Amount)

The charging amount was evaluated at an initial stage of printing and also after printing 50000 prints. The evaluated charging amount was obtained from a difference between at an initial stage of printing and after printing 50000 prints. In addition, the charging amount was measured with a blow-off method.

The charging amount was measured by a blow-off type charging amount measuring apparatus (TB-200, manufactured by Toshiba Chemical Corporation).

A two-component developer to be measured was set to the foregoing charging amount measuring apparatus equipped with a stainless steel screen of 400 mesh, in which the toner was blown for 10 minutes with nitrogen gas at a blowing pressure of 50 kPa, to measure a charging amount. The charging amount in μC/g was calculated by dividing the measured charging amount by the weight of the scattered toner.

The difference between at an initial stage of printing and after printing 50000 prints being at most 5 μC/g is at a level of no problem.

(Toner Scattering)

The toner scattering was evaluated and obtained from a visually observed contamination situation inside the apparatus caused by toner leakage and toner scattering around a developing device generated after printing 50000 prints, and contamination failure of a printed image caused by toner scattering.

Evaluation Criteria

A: Neither contamination inside an apparatus caused by toner leakage and toner scattering is observed, nor contamination failure of a printed image caused by toner scattering is observed.

B: Slight contamination inside an apparatus caused by toner leakage and toner scattering is observed, but no contamination failure of a printed image caused by toner scattering is observed (No problem in practical use).

C: Contamination inside an apparatus caused by toner leakage and toner scattering is largely observed, and contamination failure of a printed image caused by toner scattering is observed (Problem in practical use).

Evaluation results are shown in Table 2.

TABLE 2

| | Core particle | Carrier | Toner | *1 | At initial stage of printing *2 | At initial stage of printing Fog | After printing 50000 prints *2 | After printing 50000 prints Fog | Toner scattering | *3 |
|---|---|---|---|---|---|---|---|---|---|---|
| Ex. 1 | Core particle A | Carrier A | Toner 2 | 8 | 45 | 0.001 | 40 | 0.002 | A | 5 |
| Ex. 2 | Core particle B | Carrier B | Toner 2 | 8 | 42 | 0.001 | 41 | 0.002 | A | 1 |
| Ex. 3 | Core particle C | Carrier C | Toner 1 | 10 | 43 | 0.002 | 39 | 0.004 | A | 4 |
| Ex. 4 | Core particle D | Carrier D | Toner 3 | 6 | 45 | 0.003 | 40 | 0.005 | B | 5 |
| Ex. 5 | Core particle E | Carrier E | Toner 2 | 8 | 40 | 0.003 | 36 | 0.005 | A | 4 |
| Comp. 1 | Core particle F | Carrier F | Toner 2 | 8 | 38 | 0.009 | 27 | 0.015 | C | 11 |
| Comp. 2 | Core particle G | Carrier G | Toner 2 | 8 | 39 | 0.007 | 30 | 0.009 | C | 9 |
| Comp. 3 | Core particle H | Carrier H | Toner 2 | 8 | 36 | 0.012 | 24 | 0.020 | C | 12 |

Ex.: Example
Comp.: Comparative example
*1: Toner content (% by weight)
*2: Charging amount (μC/g)
*3: Charging amount difference between at an initial stage of printing and after printing 50000 prints (μC/g)

As is clear from Table 2, it is to be understood that Examples 1-5 exhibit small variation of the charging amount, as well as no problem caused by toner scattering together with reduced fog. On the other hand, it is also to be understood that Comparative examples 1-3 have produced a problem in any of the evaluation items.

EFFECT OF THE INVENTION

In the present invention, grains constituting the surface, that have even shape, make it possible to develop a small carrier core by finding out a production environment with no stress applied as much as possible, when a carrier core with Mg-containing ferrite is prepared. As a result, it was possible to provide a carrier exhibiting stable charge providing ability in which sufficient electrification was provided to toner, and no image contamination such as fog caused by toner scattering via lack of electrification was generated.

It also became possible to provide a carrier capable of maintaining a stable charging level of no interference for image formation even under the image forming condition at which a charging level for printing a number of prints continuously was difficult to be maintained. As a result, the carrier made it possible to stably form excellent toner images any time.

What is claimed is:

1. A method of preparing a carrier comprising a core particle made of ferrite comprising Mg and coated thereon, a resin, comprising the steps of:

(1) preparing a raw material to produce the ferrite containing Mg by mixing compounds;

(2) wet mixing by adding water into the mixture obtained in step (1), dispersing the resulting to prepare slurry, and also adjusting concentration of the slurry, to at least 70% by weight;

(3) wet pulverizing the slurry to obtain a pulverized material;

(4) granulating and drying the pulverized material to obtain a ferrite granulated material;

(5) baking the ferrite granulated material at a baking temperature of at least 1500° C.;

(6) pulverizing the baked ferrite granulated material;

(7) classifying the pulverized baked material to obtain the core particle; and (8) coating the core particle with the resin, wherein the core particle has a ratio of the number of irregular-shaped core particles of at most 5%, based on the total number of core particles, and a surface of the core particle has grains having a maximum grain diameter of 2-5 μM.

2. The method of claim 1, wherein the carrier has an average particle diameter of 20-40 μm.

3. The method of claim 1, wherein the core particle ferrite comprises Mn.

4. The method of claim 1, wherein the maximum grain diameter is 2-4 μm.

5. The method of claim 2, wherein the average particle diameter is 25-37 μm.

6. The method of claim 1, wherein the carrier has a magnetic attraction of 40-70 $Am^2/kg$.

7. The method of claim 6, wherein the magnetic attraction is 45-60 $Am^2/kg$.

8. The method of claim 1, wherein a layer made of the resin, coated on a surface of the core particle covers the surface at least 70% in surface area.

* * * * *